US007979240B2

(12) United States Patent
Fielder

(10) Patent No.: US 7,979,240 B2
(45) Date of Patent: Jul. 12, 2011

(54) SYSTEM AND METHOD FOR REAL-TIME MONITORING AND FAILURE PREDICTION OF ELECTRICAL SUBMERSIBLE PUMPS

(75) Inventor: Lance I. Fielder, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1450 days.

(21) Appl. No.: 11/308,420

(22) Filed: Mar. 23, 2006

(65) Prior Publication Data

US 2007/0252717 A1 Nov. 1, 2007

(51) Int. Cl.
*G01B 21/00* (2006.01)

(52) U.S. Cl. ..... 702/185; 702/1; 702/2; 702/6; 702/9; 702/14; 702/16; 367/149

(58) Field of Classification Search ..... 702/1, 2, 702/6, 9, 14, 16, 185; 367/149
See application file for complete search history.

(56) References Cited

U.S. PATENT DOCUMENTS

| | | | |
|---|---|---|---|
| 4,215,412 | A | 7/1980 | Bernier et al. |
| 4,509,901 | A | 4/1985 | McTamaney et al. |
| 5,210,704 | A | 5/1993 | Husseiny |
| 5,284,422 | A | 2/1994 | Turner et al. |
| 5,311,562 | A | 5/1994 | Palusamy et al. |
| 5,362,206 | A | 11/1994 | Westerman et al. |
| 5,602,761 | A | 2/1997 | Spoerre et al. |
| 5,748,500 | A | 5/1998 | Quentin et al. |
| 6,199,018 | B1 | 3/2001 | Quist et al. |
| 6,654,697 | B1 | 11/2003 | Eryurek et al. |
| 6,745,151 | B2 | 6/2004 | Marko et al. |
| 6,763,312 | B1 | 7/2004 | Judd |
| 6,834,256 | B2 | 12/2004 | House et al. |
| 6,839,660 | B2 | 1/2005 | Eryurek et al. |
| 2004/0141420 | A1 * | 7/2004 | Hardage et al. ..... 367/149 |

OTHER PUBLICATIONS

Phang et al. "Simulation of Variable Speed Drives for Remote Downhole Pumps Application," Sep. 1998.*
Yacamini et al. "Variable Speed Drives for Remote Pump Applications," Feb. 2000.*
Bates, et al., "Taking the Pulse of Producing Wells—ESP Surveillance," Oilfield Review, Summer 2004, pp. 16-25.
Ghiselin, "Pumps pay off", Harts E&P, Mar. 2005, 2 pages.

* cited by examiner

*Primary Examiner* — Sujoy K Kundu
(74) *Attorney, Agent, or Firm* — Kevin B. McGoff; Jim Patterson; Rodney Warfford

(57) ABSTRACT

The present application relates to a system and method for real-time monitoring and failure prediction of electrical submersible pumps. The design includes generating a failure prediction value with a management system by calculating a percentage change of the respective first measurement values and the corresponding user-supplied stable operating values, the failure prediction value representing likelihood of failure of the electrical submersible pump.

32 Claims, 6 Drawing Sheets

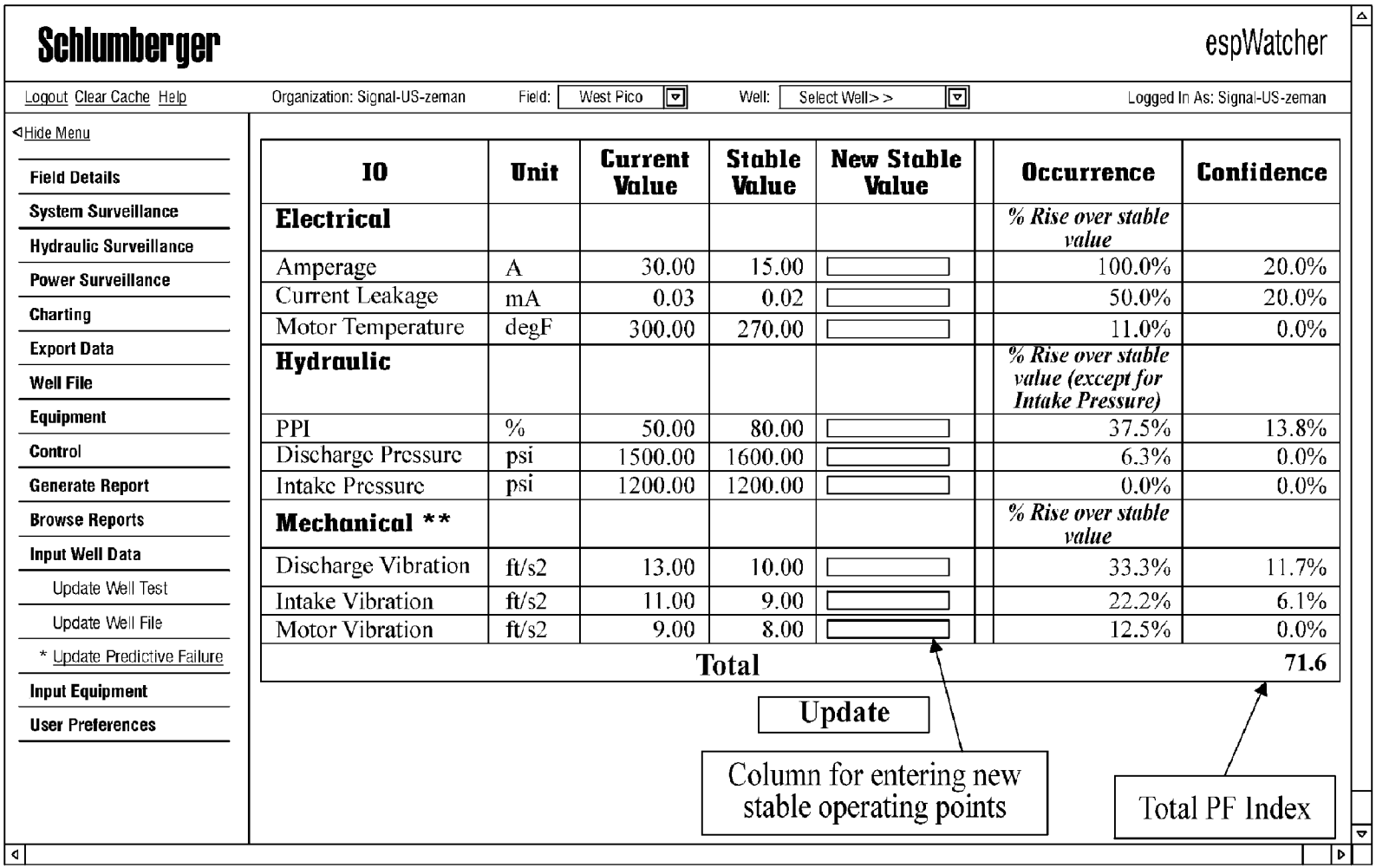

| IO | Unit | Current Value | Stable Value | New Stable Value | Occurrence | Confidence |
|---|---|---|---|---|---|---|
| **Electrical** | | | | | *% Rise over stable value* | |
| Amperage | A | 30.00 | 15.00 | | 100.0% | 20.0% |
| Current Leakage | mA | 0.03 | 0.02 | | 50.0% | 20.0% |
| Motor Temperature | degF | 300.00 | 270.00 | | 11.0% | 0.0% |
| **Hydraulic** | | | | | *% Rise over stable value (except for Intake Pressure)* | |
| PPI | % | 50.00 | 80.00 | | 37.5% | 13.8% |
| Discharge Pressure | psi | 1500.00 | 1600.00 | | 6.3% | 0.0% |
| Intake Pressure | psi | 1200.00 | 1200.00 | | 0.0% | 0.0% |
| **Mechanical **** | | | | | *% Rise over stable value* | |
| Discharge Vibration | ft/s2 | 13.00 | 10.00 | | 33.3% | 11.7% |
| Intake Vibration | ft/s2 | 11.00 | 9.00 | | 22.2% | 6.1% |
| Motor Vibration | ft/s2 | 9.00 | 8.00 | | 12.5% | 0.0% |
| **Total** | | | | | | **71.6** |

*FIG. 3*

PFI Gauge

Schlumberger espWatcher

Logout Clear Cache Help Organization: Aethon-US-oilochonwu Field: Dora Roberts Well: Warder 31 Logged In As: Aethon-US-oilochonwu Hide Menu

- Field Details
- System Surveillance
  - * Streaming
  - Episodic
- Hydraulic Surveillance
- Power Surveillance
- Charting
- Export Data
- Well File
- Equipment
- Control
- Generate Report
- Browse Reports
- Input Well Data
- Input Equipment
- User Preferences

PFI = 81%

| Alarm | I/O | Value | Unit | Timestamp | Red Alarm Limits | Yellow Alert Limits | Validation Status | Comment |
|---|---|---|---|---|---|---|---|---|
| H | Active Current Leakage | 0.01 | mA | 25-Jan-2006 14:00:31 | Not Set - Not Set | Not Set - Not Set | | |
| H ○ | Average Amps | 74.0 | A | 25-Jan-2006 14:00:31 | Not Set - Not Set | 34.0 - 43.0 | Validated (Green) | |
| H | Current Unbalance | 14.1 | % | 25-Jan-2006 14:00:31 | Not Set - Not Set | Not Set - 1000.0 | | |
| H | Intake Pressure | 135.0 | psi | 25-Jan-2006 14:00:31 | Not Set - Not Set | Not Set - Not Set | | |
| H | Intake Temperature | 95.1 | degF | 25-Jan-2006 14:00:31 | Not Set - Not Set | Not Set - Not Set | | |
| H | Motor Temperature | 99.4 | degF | 25-Jan-2006 14:00:31 | Not Set - Not Set | Not Set - Not Set | | |
| H | Number of Starts | 148.0 | | 25-Jan-2006 14:00:31 | Not Set - Not Set | Not Set - Not Set | | |
| H | Passive Current Leakage | 0.0 | mA | 25-Jan-2006 14:00:31 | Not Set - Not Set | Not Set - Not Set | | |
| H | Power Factor | 9.0 | % | 25-Jan-2006 14:00:31 | Not Set - Not Set | Not Set - Not Set | | |
| H | Vibration | 18.66 | ft/s2 | 25-Jan-2006 14:00:31 | Not Set - Not Set | Not Set - Not Set | | |
| H | Alarm/Trip Status | 0.0 | | 25-Jan-2006 14:00:31 | Not Set - 2.0 | Not Set - 1.0 | | |
| H | Auto Mode Selected | 1.0 | | 25-Jan-2006 14:00:31 | NaN - NaN | Not Set - Not Set | | |
| H | Cf | 18.88 | mA | 25-Jan-2006 14:00:31 | Not Set - Not Set | Not Set - Not Set | | |
| H ○ | Contactor Output | 1.0 | | 25-Jan-2006 14:00:31 | NaN - NaN | 0.0 - 1.0 | Validated (Green) | |
| H | Cz | 10.29 | mA | 25-Jan-2006 14:00:31 | Not Set - Not Set | Not Set - Not Set | | |
| H | Fault Status | 0.0 | | 25-Jan-2006 14:00:31 | Not Set - Not Set | Not Set - Not Set | | |
| H | Kx95 Alarm | 0.0 | | 25-Jan-2006 14:00:31 | Not Set - Not Set | Not Set - Not Set | | |
| H | Latched Alarms | 32.0 | | 25-Jan-2006 14:00:31 | Not Set - Not Set | Not Set - Not Set | | |
| H | Maximum starts lockout alarm status | 0.0 | | 25-Jan-2006 14:00:31 | NaN - NaN | Not Set - 1.0 | | |
| H | Shutdown Cause | 10.0 | | 25-Jan-2006 14:00:31 | Not Set - Not Set | Not Set - Not Set | | |
| H ○ | Supply Voltage | 100.0 | V | 25-Jan-2006 14:00:31 | Not Set - Not Set | 118.0 - 128.0 | Validated (Green) | |

*FIG. 5A*

SYSTEM AND METHOD FOR REAL-TIME MONITORING AND FAILURE PREDICTION OF ELECTRICAL SUBMERSIBLE PUMPS

BACKGROUND OF THE INVENTION

1. Field of the Invention

This invention relates broadly to artificially lifted oil wells. More particularly, this invention relates to real-time monitoring and failure prediction of electrical submersible pumps.

2. Description of Related Art

In many oil wells, an artificial lift system is employed to lift fluid (e.g., petroleum) from a subterranean reservoir to a collection point. In many applications, the artificial lift system includes an electrical submersible pump that is positioned within a wellbore. The pump intakes fluid from the wellbore and pumps the fluid upwardly or laterally through the wellbore to the collection point. During extended operation, the components of the electrical submersible pump may be subject to degradation or breakage, which can lead to unwanted well intervention activities such as workovers.

In many applications, the electrical submersible pumps are installed in wells that are offshore, subsea, or in remote areas that are not easily accessible for intervention and workover. In these applications, it would be beneficial to provide operators with the ability to accurately monitor the condition of the electrical submersible pumps and effectively predict failure before it occurs such that equipment can be efficiently mobilized before a pump fails. To this end, systems have been developed that provide real-time data acquisition and monitoring of an electrical submersible pump. These systems enable operators to monitor in real-time the operational characteristics of the pump and intelligently control the operation of the pump. Such operations allow operators to identify changing well conditions as well as changing pump characteristics due to pump wear and instability, and to optimize the performance of the pump system based thereon. Such operations also allow operators to take immediate remedial action if conditions warrant such action.

Disadvantageously, current monitoring systems require experienced operators to monitor and analyze in detail the operating conditions of the pump in order to identify operating conditions that predict if and when failure of the pump system is imminent. Employing such an experienced operator (or providing an inexperienced operator with the necessary amount of training) is difficult to accomplish and costly over the operational lifetime of the pump system.

Thus, there is a need in the art to provide an electrical submersible pump monitoring system that provides a simple and user-friendly mechanism for accurately predicting pump failure and which avoids the difficulties and costs associated with the prior art systems.

BRIEF SUMMARY OF THE INVENTION

It is therefore an object of the invention to provide an electrical submersible pump monitoring system that provides a simple and user-friendly mechanism for accurately predicting pump failure.

It is another object of the invention to provide such a monitoring system which avoids the difficulties and costs associated with the prior art.

It is a further object of the invention to provide such a monitoring system in which the failure prediction mechanism can simply and intuitively be updated by the user over the operational lifetime of the electrical submersible pump system, if needed.

In accord with these objects, which will be discussed in detail below, a method of (and corresponding system for) monitoring an electrical submersible pump stores first measurement values associated with a plurality of operating parameters of the electrical submersible pump. The first measurement values include subsets corresponding to operating parameters (e.g., operating amperage, current leakage, current imbalance, motor temperature, pump performance index, discharge pressure, intake pressure, discharge vibration, intake vibration, and motor vibration). Each subset of first measurement values is obtained during downhole operation of the electrical submersible pump over time. Users define a plurality of user-supplied stable operating values corresponding to the operating parameters. A failure prediction value representing likelihood of failure of the electrical submersible pump is generated based upon the first measurement values and the user-supplied stable operating values. The failure prediction value is stored for subsequent output and monitoring of the electrical submersible pump.

In the preferred embodiment, for each operating parameter, the first measurement values are processed to generate a second measurement value characterizing the current condition of the operating parameter, and a third measurement value is calculated as a percentage change of the corresponding second measurement value and the corresponding user-supplied stable value. The failure prediction value is calculated by mapping the third measurement values to weight factor values, scaling the weight factor values by a set of corresponding confidence ratings to generate a set of resultant products, and then adding the resultant products.

In an illustrative embodiment of the present invention, the failure prediction value is used to generate one or more graphical user interfaces that are output to the user for monitoring and alarm purposes. Such graphical user interface(s) preferably include at least one of: a display of the failure prediction value itself, at least one visual alarm that is raised in the event that the failure prediction value exceeds a predetermined threshold value, a description of the underlying cause of an alarm condition, and a gauge that visually depicts the failure prediction value.

It will be appreciated that electrical submersible pump (ESP) monitoring methodology (and systems based thereon) provide improved mechanisms for predicting the failure of ESP systems and reporting such predictions to users. Importantly, the predictions are based on the acquisition, collection, and storage of sufficient data on key operating points of the ESP system. The mechanisms also provide a simple and intuitive interface that allows users to modify and update the fault prediction mechanism during the operational lifetime of the ESP system in order to ensure accurate fault prediction over time. Because the simple and intuitive interface does not require extensive training or experience to understand, a wide range of operators can monitor and analyze the operating conditions of the ESP system, which aids in reducing monitoring costs.

Additional objects and advantages of the invention will become apparent to those skilled in the art upon reference to the detailed description taken in conjunction with the provided figures.

BRIEF DESCRIPTION OF THE DRAWINGS

FIG. 3 is a pictorial illustration of an exemplary graphical user interface that allows for users to dynamically update the stable operating values that are used as part of the failure prediction calculations carried out in FIG. 2.

FIG. 5A is a pictorial illustration of an exemplary graphical user interface for communicating failure prediction information that is based upon the failure prediction calculations carried out in FIG. 2 along with other system surveillance information.

DETAILED DESCRIPTION OF THE INVENTION

The present invention generally relates to a system and method for real-time monitoring and failure prediction of electrical submersible pumps. The system and method employ real-time data acquisition and monitoring of the downhole pumping system along with automatic computer-implemented fault prediction. Such fault prediction enables the well operator (or well field manager) to more efficiently and effectively predict failure of the downhole pumping system before it occurs, thereby minimizing the risk of catastrophic failure and the costs associated therewith.

Figure 1:
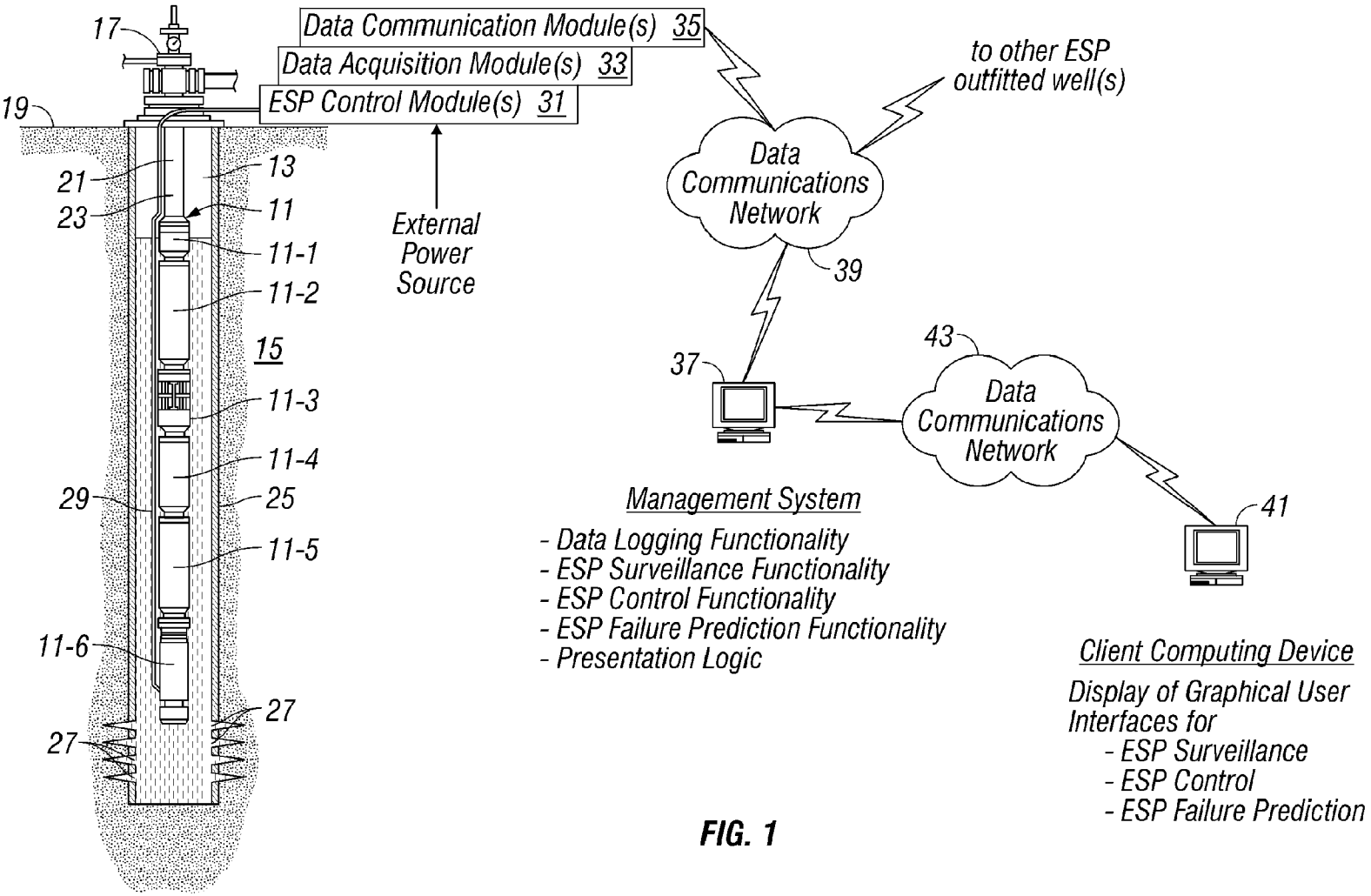
FIG. 1 is a system block diagram in which the present invention is embodied.

Turning now to FIG. 1, an exemplary electrical submersible pumping system 11 is shown disposed within a wellbore 13 drilled or otherwise formed in a geological formation 15. Electrical submersible pumping system 11 is suspended below a wellhead 17 disposed, for example, at a surface 19 of the earth. Pumping system 11 is suspended by a deployment system 21, such as production tubing, coiled tubing, or other deployment system. In the embodiment illustrated, deployment system 21 comprises tubing 23 through which well fluid is produced to wellhead 17.

As illustrated, wellbore 13 is lined with a wellbore casing 25 having perforations 27 through which fluid flows between formation 15 and wellbore 13. For example, a hydrocarbon-based fluid may flow from formation 15 through perforations 27 and into wellbore 13 adjacent electrical submersible pumping system 11. Upon entering wellbore 13, pumping system 11 operates to pump the fluid upwardly through tubing 23 to the wellhead 17 and on to a desired collection point.

The electrical submersible pumping system 11 may comprise a wide variety of components depending on the particular application or environment in which it is used. The exemplary electrical submersible pumping system 11 shown in FIG. 1 includes a discharge section 11-1, a pump section 11-2, an intake section 11-3, a protection/seal section 11-4, and a motor section 11-5. The pump section 11-2 provides mechanical elements (e.g., vanes, pistons) that pump fluid from the intake section 11-3 and out the discharge section 11-1 for supply to the surface. The intake section 11-3 has intake ports that provide a fluid path for drawing fluid into the pump section 11-2 from the wellbore 13. The protector/seal section 11-4 transmits torque generated by the motor section 11-5 to the pump section 11-2 for driving the pump. The protector/seal section 11-4 also provides a seal against fluids/contaminants entering the motor section 11-5. The motor section 11-5 includes an electric motor assembly that is driven by electric power supplied thereto from the surface. A sensor unit 11-6, which is disposed on the bottom end of the electrical submersible pump system 11, provides an additional clamping position as well as means for protecting the system 11 when running the completion.

At least one surface-located ESP control module 31 is provided that interfaces to an external power source and controls the supply of electric power to the ESP motor section 11-5 via power cables 29 therebetween. The power cables 29 (which are typically realized by armored-protected, insulated conductors) extend through the wellhead 17 and downward along the exterior of the tubing 23 in the annular space between the tubing 23 and the casing 25. The ESP control module(s) 31 is capable of selectively turning on and shutting off the supply of power to the ESP motor section 11-5. The ESP control module(s) 31 may also incorporate variable-speed drive functionality that adjusts pump output by varying the operational motor speed of the ESP motor section 11-5. The ESP control module(s) 31 may also include sensors for real-time measurement of various operating parameters of the ESP system 11, such as the power supply voltage, amperage, and possibly current imbalance of the ESP system 11.

The sensor unit 11-6 of the ESP system 11 also includes or interfaces to sensors that provide real-time measurement of various downhole operating parameters of the electrical submersible pumping system 11. In the preferred embodiment, the discharge section 11-1 (or another part of the system adjacent thereto) includes a vibration sensor for real-time measurement of localized vibrations of the discharge section 11-1 as well as a pressure sensor for real-time measurement of localized fluid pressure within or adjacent to the discharge section 11-1. Similarly, the intake section 11-3 (or another part of the system adjacent thereto) includes a vibration sensor for real-time measurement of localized vibrations of the intake section 11-3 as well as a pressure sensor for real-time measurement of localized fluid pressure within or adjacent to the intake section 11-3. Finally, the motor section 11-5 (or another part of the system adjacent thereto) includes a vibration sensor for real-time measurement of localized vibrations of the motor section 11-5, a sensor for real-time measurement of current leakage of the motor, and a temperature sensor for real-time measurement of localized temperature within or adjacent to the motor section 11-5. In the preferred embodiment, the temperature sensor of the sensor unit 11-6 measures motor oil temperature or motor winding temperature. An example of a commercially available sensor unit 11-6 that includes such functionality is the Phoenix Multisensor XT product sold by Schlumberger.

The sensor unit 11-6 also includes downhole communication equipment for telemetry of the measured downhole parameters to a surface-located data acquisition module 33. In the preferred embodiment, telemetry between the sensor unit 11-6 and the surface-located data acquisition module 33 is accomplished by communication of modulated signals over the power cables 29. Alternatively, such telemetry can be accomplished by a wireless radio-frequency data communication link therebetween or any other form of data communication, including communication links employing wires or fiber optic cables.

The ESP control module 31 and the data acquisition module 33 interface to a data communication module 35 that provides two-way data communication to a remote management system 37 over a data communications network 39. The network 39 preferably includes a satellite communication network for data communication to and from the data communication module 35, although other types of data communication networks can be used. The remote management system 37 is preferably realized by one or more programmed computer systems having a central processing unit which is operatively coupled to a memory (e.g., semiconductor memory and non-volatile memory such as one or more hard disk drives) as well as a user input device and an output device. The user input device may comprise a variety of devices, such as a keyboard, mouse, voice-recognition unit, touchscreen, other input devices, or combinations of such devices. The output device may comprise one or more display devices (e.g., display monitor(s) or display screen(s)) and/or one or more audio output devices (e.g., audio speaker system). The remote management system 37 includes data logging functionality, ESP surveillance functionality, ESP control functionality, ESP failure prediction functionality, and presentation logic as described below.

The ESP data logging functionality stores data representing the operating parameter measurements of the electrical submersible pumping system 11 over time. Such operating parameter measurements are generated by the ESP control module 31 and/or collected by the data acquisition module 33 and communicated to the management system 37 via the data communication module 35 and data communications network 39 for real-time monitoring and control. In the illustrative embodiment, the data logging functionality collects and stores data representing at least the following operational parameter measurements over time for each given ESP system:

i) operating voltage (as measured by the ESP control module 31);

ii) operating amperage (as measured by the ESP control module 31);

iii) current imbalance (as measured by the ESP control module 31);

iv) current leakage (as measured by the sensor unit 11-6);

v) motor temperature (as measured by the sensor unit 11-6);

vi) pressure at or near the ESP discharge section (as measured by the sensor unit 11-6);

vii) pressure at or near the ESP intake section (as measured by the sensor unit 11-6);

viii) vibration of the ESP discharge section (as measured by the sensor unit 11-6);

ix) vibration of the ESP intake section (as measured by the sensor unit 11-6); and x) vibration at or near the ESP motor section (as measured by the sensor unit 11-6).

Figure 4:
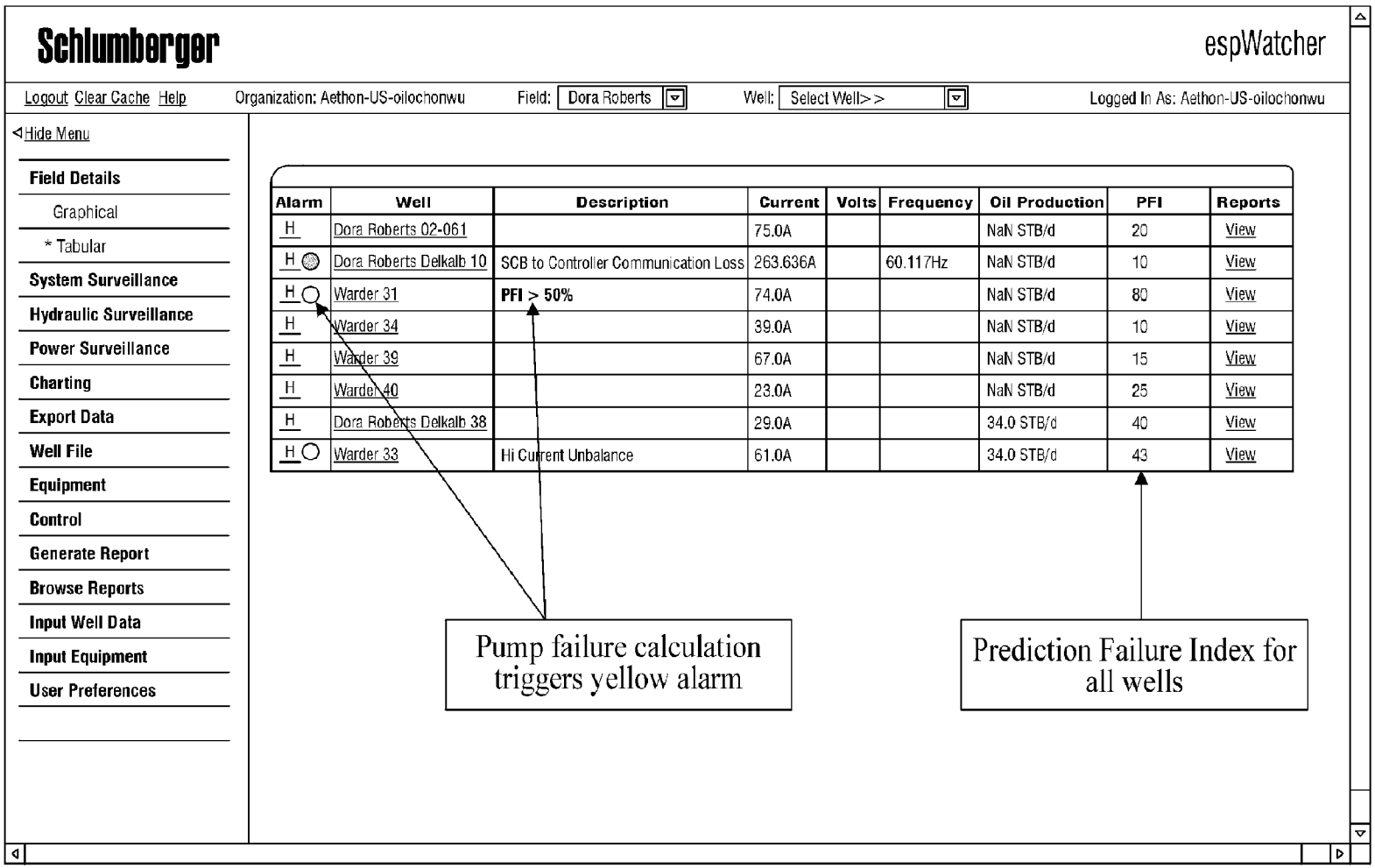
FIG. 4 is a pictorial illustration of an exemplary graphical user interface for communicating failure prediction information that is based upon the failure prediction calculations carried out in FIG. 2 along with other well surveillance information.
Figure 5B:
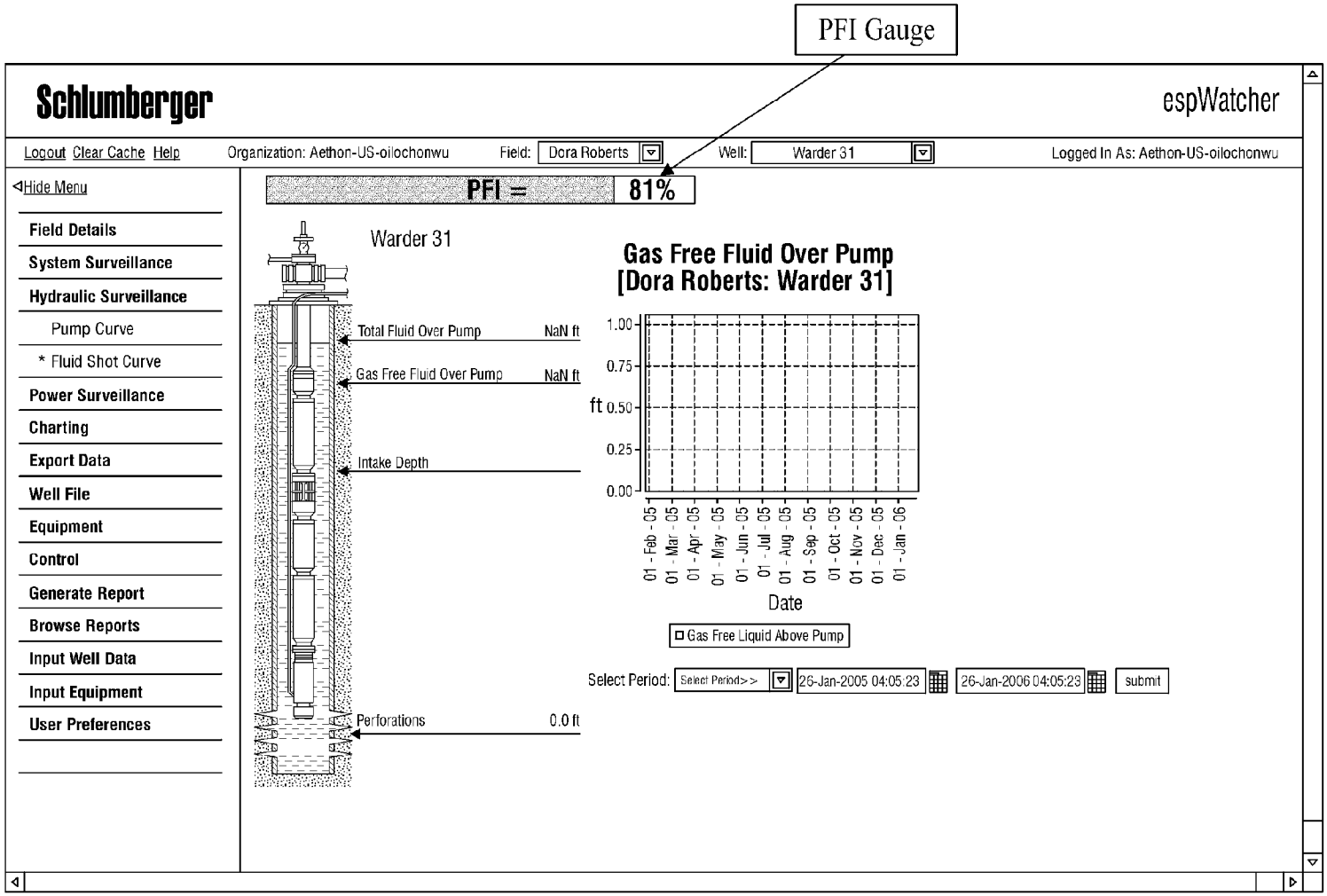
FIG. 5B is a pictorial illustration of an exemplary graphical user interface for communicating failure prediction information that is based upon the failure prediction calculations carried out in FIG. 2 along with other hydraulic surveillance information.

The ESP surveillance functionality analyzes the operational parameter data collected by the data logging functionality over time to create summaries (e.g., episodic summaries and other trend curves) and reports that assist in evaluating the performance of a given ESP system. In the preferred embodiment of the invention, the ESP surveillance functionality measures trended parameters including a pump performance index (PPI) that is calculated based upon the difference between the operational lift performance of the ESP system (derived from the real-time operational parameter data of the ESP system) and factory tested lift performance of the ESP system. The ESP surveillance functionality also cooperates with the presentation logic to generate graphical user interfaces that enable users to view the operational parameters stored by the data logging functionality as well as the summaries and reports based thereon for monitoring and alarm purposes (FIGS. 4, 5A, 5B).

The ESP control functionality cooperates with the presentation logic to generate graphical user interfaces that enable users to request predetermined control operations (e.g., turn ESP motor on, turn ESP motor off, adjust ESP motor speed) for particular ESP systems managed by the management system 37. Such requests are translated to appropriate commands that are communicated to the desired ESP system via the data communications network 39.

The ESP failure prediction functionality processes the operating parameter data stored by the data logging functionality to generate an index (or score) that represents the likelihood that a particular ESP system 11 will fail (referred to below as a Prediction Failure Index or PFI). The ESP failure prediction functionality also cooperates with the presentation logic to generate one or more graphical user interfaces that display the PFI value and other information based thereon for output to requesting users for monitoring and alarm purposes (e.g., FIGS. 3, 4, 5A, 5B).

Users interface to the presentation logic in order to request, access and display the graphical user interfaces generated by the presentation logic in cooperation with the ESP surveillance functionality, the ESP control functionality, and the ESP failure prediction functionality. In the illustrative embodiment shown, which is typical client-server architecture, the interface between a user and the presentation logic is realized by the execution of a suitable application on one or more client computing devices (one shown as 41) that are coupled to the management system 37 over a data communications network 43. Upon receipt of a requested graphical user interface, the application operates to render and display the graphical user interface on the display device of the client computing device. In alternative embodiments, the request, access, and display of the graphical user interfaces generated by the presentation logic can be realized as part of the management system 37 itself.

In the preferred embodiment, the graphical user interfaces generated by the presentation logic in cooperation with the ESP surveillance functionality, the ESP control functionality, and the ESP failure prediction functionality are realized as web pages (e.g., html documents, a raw text file, an image, or some other type of document). Such web pages are served by a web server module in accordance with user requests directed thereto. The web server module, which is preferably realized as part of the management system 37, receives such user requests over the data communications network 43 from web-browser applications executing on the client computing devices (e.g., client computing device 41). The requested graphical user interface is generated and then returned by the web server module for display at the requesting client computing device.

Figure 2:
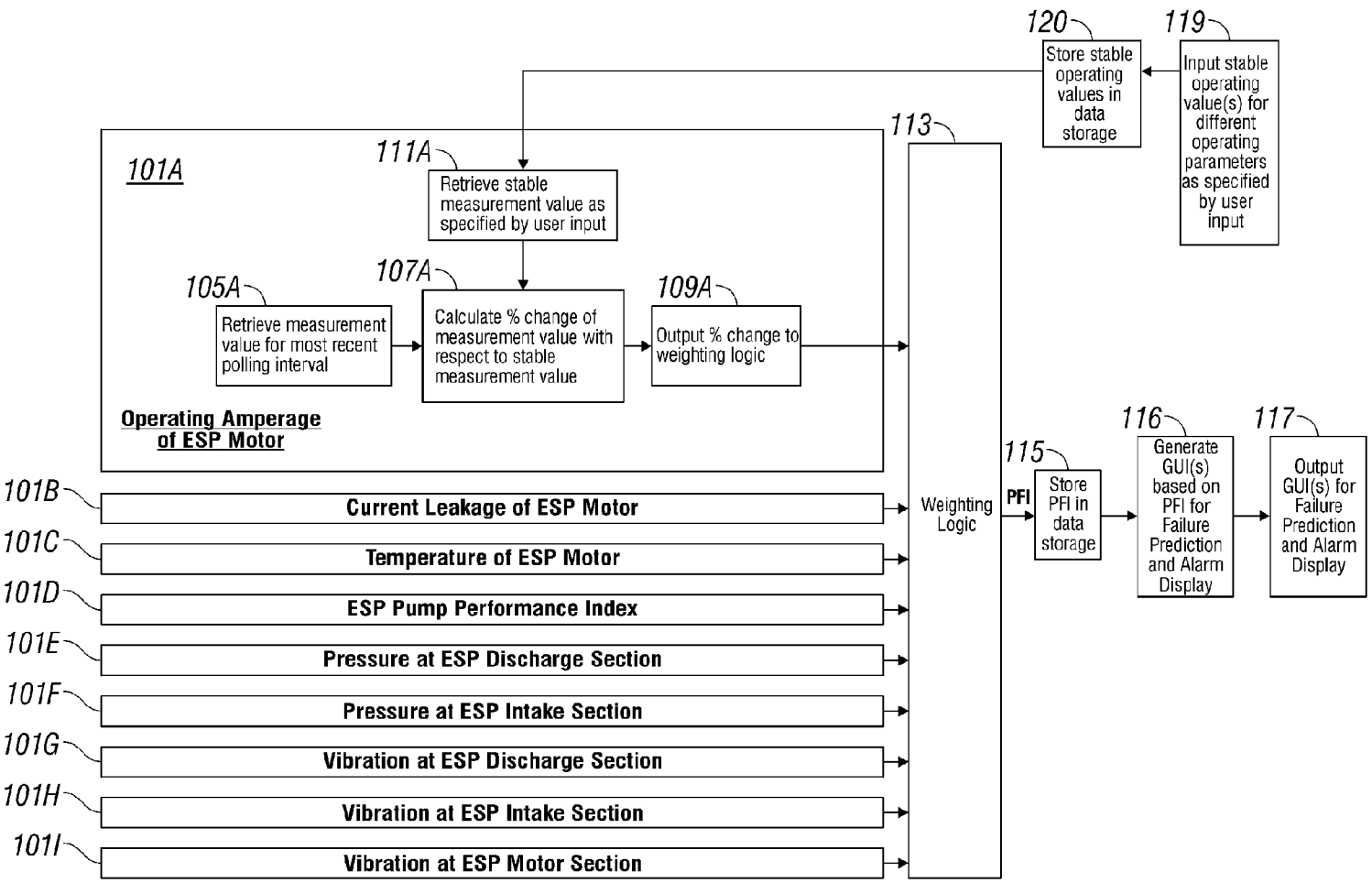
FIG. 2 is a functional block diagram of the logic carried out by the failure prediction functionality and presentation logic of the management station of FIG. 1 in accordance with the present invention.

FIG. 2 illustrates the logic embodied by the ESP failure prediction functionality and presentation logic of the management system 37 in accordance with the present invention. It includes a set of blocks 101A-101I corresponding to respective ESP operating parameters. Each one of the blocks 101A-101I is responsible for calculating the percentage change of the respective ESP operating parameter based upon the corresponding parameter operating data collected and stored by the data logging functionality and outputting the calculated percentage change value to weighting logic 113. In this manner, block 101A calculates and outputs the percentage change value for the operating amperage of a given ESP system based upon the ESP operating amperage data collected and stored by the data logging functionality. Block 101B calculates and outputs the percentage change value for the current leakage of the given ESP system based upon the ESP current leakage data collected and stored by the data logging functionality. Block 101C calculates and outputs the percentage change value for the motor temperature of the given ESP system based upon the ESP motor temperature data collected and stored by the data logging functionality.

Block 101D calculates and outputs the percentage change value for the PPI of the given ESP system based upon the PPI data calculated and stored by the trending functionality. Block 101E calculates and outputs the percentage change value for the ESP discharge pressure of the given ESP system based upon the ESP discharge pressure data collected and stored by the data logging functionality. Block 101F calculates and outputs the percentage change value for the ESP intake pressure of the given ESP system based upon the ESP intake pressure data collected and stored by the data logging functionality. Block 101G calculates and outputs the percentage change value for the ESP discharge vibration of the given ESP system based upon the ESP discharge vibration data collected and stored by the data logging functionality. Block 101H calculates and outputs the percentage change value for the ESP intake vibration of the given ESP system based upon the ESP intake vibration data collected and stored by the data logging functionality. Block 101I calculates and outputs the percentage change value for the ESP motor vibration of the given ESP system based upon the ESP motor vibration data collected and stored by the data logging functionality.

As shown in detail in block 101A, the percentage change value for the operating current is determined by retrieving the stored operating current measurement for the most recent polling interval (block 105A), which has been collected and stored by the data logging functionality of the management system 37. A stable operating current measurement value is retrieved from data storage (block 111A). This stable operating current measurement value is set by user input (block 119 and the graphical user interface of FIG. 3) and stored in data storage (block 120). The percentage change of the measured operating current with respect to the user-input stable operating current value is calculated in block 107A. This is preferably accomplished as follows:

% change=[operating current measurement value (block 105*A*)−stable operating current measurement value (block 111*A*)]/[stable operating current measurement value (block 111*A*)].

In block 109A, the percentage change calculated in block 107A is output to the weighting logic 113. Similar operations are performed for the blocks 101B-101I to thereby calculate and output the percentage change of the various operating parameters corresponding thereto. Note that intake pressure typically falls over time. Thus, the percent change for intake pressure is calculated as the percent fall relative to the user-supplied stable intake pressure.

The weighting logic 113 maps the percentage change values supplied thereto to a corresponding set of weight factor values (denoted $wf_A$, $wf_B$ . . . $wf_I$). In this manner, the percentage change value for ESP operating current calculated and output in block 101A is mapped to weight factor $wf_A$. The percentage change value for ESP current leakage calculated and output in block 101B is mapped to a weight factor $wf_B$. The percentage change value for the ESP motor temperature calculated and output in block 101C is mapped to a weight factor $wf_c$. The percentage change value for ESP PPI calculated and output in block 101D is mapped to a weight factor $wf_D$. The percentage change value for ESP discharge pressure calculated and output in block 101E is mapped to a weight factor $wf_E$. The percentage change value for ESP intake pressure calculated and output in block 101F is mapped to a weight factor $wf_F$. The percentage change value for ESP discharge vibration calculated and output in block 101G is mapped to a weight factor $wf_G$. The percentage change value for ESP intake vibration calculated and output in block 101H is mapped to a weight factor $wf_H$. Finally, the percentage change value for ESP motor vibration calculated and output in block 101I is mapped to a weight factor $wf_I$.

A table that illustrates an example of such mapping operations is set forth below.

Block 101A - ESP Operating Amperage

| % change | $wf_A$ |
|---|---|
| <20 | 0.00 |
| 20-30 | 0.05 |
| 30-40 | 0.10 |
| 40-50 | 0.15 |
| >50 | 0.20 |

Block 101B - ESP Current Leakage

| % change | $wf_B$ |
|---|---|
| <20 | 0.00 |
| 20-30 | 0.05 |
| 30-40 | 0.10 |
| 40-50 | 0.15 |
| >50 | 0.20 |

Block 101C - ESP Motor Temperature

| % change | $wf_C$ |
|---|---|
| <20 | 0.00 |
| 20-30 | 0.05 |
| 30-40 | 0.10 |
| 40-50 | 0.15 |
| >50 | 0.20 |

Block 101D - ESP Pump Performance Index (PPI)

| % change | $wf_D$ |
|---|---|
| <20 | 0.00 |
| 20-30 | 0.05 |
| 30-40 | 0.10 |
| 40-50 | 0.15 |
| >50 | 0.20 |

Block 101E - ESP Discharge Pressure

| % change | $wf_E$ |
|---|---|
| <20 | 0.00 |
| 20-30 | 0.05 |
| 30-40 | 0.10 |
| 40-50 | 0.15 |
| >50 | 0.20 |

| Block 101F - ESP Intake Pressure | |
|---|---|
| % change | $wf_F$ |
| <20 | 0.00 |
| 20-30 | 0.05 |
| 30-40 | 0.10 |
| 40-50 | 0.15 |
| >50 | 0.20 |

| Block 101G - ESP Discharge Vibration | |
|---|---|
| % change | $wf_G$ |
| <20 | 0.00 |
| 20-30 | 0.05 |
| 30-40 | 0.10 |
| 40-50 | 0.15 |
| >50 | 0.20 |

| Block 101H - ESP Intake Vibration | |
|---|---|
| % change | $wf_H$ |
| <20 | 0.00 |
| 20-30 | 0.05 |
| 30-40 | 0.10 |
| 40-50 | 0.15 |
| >50 | 0.20 |

| Block 101I - ESP Motor Vibration | |
|---|---|
| % change | $wf_I$ |
| <20 | 0.00 |
| 20-30 | 0.05 |
| 30-40 | 0.10 |
| 40-50 | 0.15 |
| >50 | 0.20 |

In the preferred embodiment, such mappings are fixed by the design of the weighting logic 113 and cannot be updated by the user. Alternatively, such mappings can be exposed through a graphical user interface that allows for update by the user. Moreover, the mappings shown above are for illustrative purposes only and can readily be modified for different applications as needed.

The weighting logic 113 then calculates a PFI value by scaling each weight factor value $wf_i$ by an associated confidence rating ($cr_i$) and then totaling the products as follows:

$$PFI = [(wf_A * cr_A) + (wf_B * cr_B) + (wf_C * cr_C) + (wf_D * cr_D) + (wf_E * cr_E) + (wf_F * cr_F) + (wf_G * cr_G) + (wf_H * cr_H) + (wr_I * cr_I)]$$

In an exemplary embodiment shown in FIG. 3, the confidence rating $cr_A$ is assigned a value of 0.200 (or 20.0%), the confidence rating $cr_B$ is assigned a value of 0.200 (or 20.0%), the confidence rating crc is assigned a value of 0.00 (or 0.0), the confidence rating $cr_D$ is assigned a value of 0.138 (or 13.8%), the confidence rating $cr_E$ is assigned a value of 0.00 (or 0.0%); the confidence rating $cr_F$ is assigned a value of 0.0 (or 0.0%); the confidence rating $cr_G$ is assigned a value of 0.117 (or 11.7%); the confidence rating $cr_H$ is assigned a value of 0.61 (or 6.1%); and the confidence rating $cr_I$ is assigned a value of 0.00 (or 0.0%). In the preferred embodiment, such confidence rating assignments are fixed by the design of the weighting logic and cannot be updated by the user. Alternatively, such confidence rating assignments can be exposed through a graphical user interface that allows for update by the user. Moreover, the confidence rating assignments shown above are for illustrative purposes only and can readily be modified for different applications as needed.

The PFI value calculated by the weighting logic 113 is output to block 115, which stores the PFI value in data storage.

In the preferred embodiment, the operations of blocks 101A thru 101I, block 113, and block 115 are performed repeatedly over successive time-sequential polling intervals for each ESP system monitored by the management system 37 in order to provide continuous monitoring of such ESP systems. Preferably, the time duration of the respective polling intervals is set by user input and thus can be dynamically adjusted as dictated by the user. The polling intervals can range from a number of seconds (e.g., every 3600 seconds), a number of hours (e.g., every 6 hours), or a number of days (e.g., daily).

In block 116, the presentation logic of the management system 37 generates one or more graphical user interfaces (GUIs) based upon the PFI value stored by block 115. In block 117, such graphical user interface(s) are output for display to one or more users. In the preferred embodiment, the graphical user interface(s) generated in block 116 display the PFI value itself (e.g., the value shown in the Total row of the web page display of FIG. 3 and the values shown in PFI column of the web page display of FIG. 4), at least one visual alarm if the PFI value exceeds a predetermined threshold value (e.g., the alarm indicator lights in the Alarm column of FIG. 4), a description of the underlying cause of an alarm condition (e.g., the text in the Description column of FIG. 4), and/or a gauge that visually depicts the PFI value (e.g., the horizontal PFI gauges shown in FIGS. 5A and 5B).

In the preferred embodiment, the graphical user interfaces generated by the presentation logic of the management system 37 include at least a predictive failure input view, a field detail view, a system surveillance view and a hydraulic surveillance view as described below in more detail.

The predictive failure input view enables users to set the stable operating parameter values that are used as part of the failure prediction calculations (blocks 119 and 120 of FIG. 2). An illustrative example of the predictive failure input view is shown in FIG. 3, which includes an array of rows and columns whose rows correspond to the respective operating parameters that are used as part of the failure prediction calculation of FIG. 2. The column labeled "IO" lists these operating parameters. The column labeled "Unit" identifies the unit of measure for these operating parameters. The column labeled "Current Value" lists the measurement value of the respective operating parameter for the most-recent polling interval. The column labeled "Stable Value" lists the current stable values of the respective operating parameters as stored in data storage. The column labeled "Occurrence" lists the percentage changes of the respective operating parameters for the most-recent polling interval. The column labeled "Confidence" lists the confidence ratings $cr_i$ for the respective operating parameters that are used as part of the failure prediction calculation of FIG. 2. The PFI value output by the weighting logic 113 of FIG. 2 is displayed in the lower right hand corner of the view in the row labeled "Total". The column labeled "New Stable Value" provides input boxes that allow the user to input new stable operating values for the respective operating parameters. These new stable operating values are committed and stored in data storage when the user clicks on the "Update" button at the bottom center part of the view.

The field detail view provides an overview of the wells operating in a given oil field and allows for tabular display of wells that have an alarm or alert, prioritized by the importance of the well. An illustrative example of the field detail view is shown in FIG. 4, which includes an array of rows and columns in a tabular form whose rows correspond to respective wells that are part of a given oil field (in this example, the "Dora Roberts" oil field) managed by the management system 37. The oil field is selected by a drop down menu at the top of the view. The column labeled "Alarm" includes links designated "H" to web pages that display the alarm history for respective wells in addition to visual alarm indicators for wells whose given PFI value exceeds certain threshold levels. More particularly, a "yellow" alarm light indicator is displayed in the event that the PFI value exceeds a first predetermined value (e.g., 0.50) and a "red" alarm light indicator is displayed in the event that the well is shut down. In the event that the PFI value for the well is below the first predetermined value, no alarm light indicator is displayed. The column labeled "Well" provides a textual description that identifies the respective wells. The column labeled "Description" provides a textual description of the underlying cause of the alarm condition, when raised. The columns labeled "Current", "Volts" and "Frequency" provide data that represents (or summarizes) the operating currents, voltages and frequencies supplied to the ESP motors of the respective wells. The column labeled "Oil Production" provides episodic input from well test data. The column labeled "PFI" displays the PFI values of the respective wells as derived from the predictive failure calculations of FIG. 2. The column labeled "Reports" provide a link to a repository where reports are managed.

The system surveillance view provides the user the ability to view streaming data from the respective wellsites as well as episodic data derived from well tests or from fluid level analysis. An illustrative example of the system surveillance view is shown in FIG. 5A, which includes an array of rows and columns whose rows correspond to respective operating parameters of a given well managed by the management system 37. The well is selected from drop down menus at the top of the view that allow for user selection of a particular oil field and particular well within that oil field. The column labeled "Alarm" provides includes links designated "H" to web pages that display the alarm history for respective wells as well as visual alarm indicators in the event that operating parameter measurements pertaining to the respective operating parameters exceed certain threshold levels. More particularly, a "yellow" alarm light indicator is displayed in the event that the operating parameter measurement exceeds a first threshold limit (which is identified in the column labeled "Yellow Alert Limits"), and a "red" alarm light indicator is displayed in the event that the operating parameter measurement exceeds a second threshold limit (which is identified in the column labeled "Red Alert Limits"). In the event that the operating parameter measurement is below the first threshold limit (or the first threshold limit is not set), no alarm light indicator is displayed. The column labeled "I/O" provides a textual description that identifies the respective operating parameters. The columns labeled "Value" and "Unit" provide the results of the operating parameter measurements and corresponding units of measure, respectively. The column labeled "Timestamp" provides time values associated with the operating parameter measurements. The column labeled "Validation Status" provides a field that expresses a confidence level (or other status related thereto) in the respective alarm raised by the system. The column labeled "Comment" provides users with the ability to make comments that other users can review. A horizontal gauge is displayed in the top left portion of the view that provides a visual indication of the PFI value for the given well. The left edge of the gauge represents a predetermined lower limit PFI value (e.g., 0.0) and the right edge of the gauge represents an upper limit PFI value (e.g., 1.0) The gauge is filled in from the left edge to a demarcation edge. The position of the demarcation edge is dependent on the PFI value of the given well as calculated in accordance with FIG. 2.

The hydraulic surveillance view displays the manual input from users, such as fluid level shots, and provides for analysis of pump performance of a given well. An illustrative example of the hydraulic surveillance view is shown in FIG. 5B for a given well managed by the management system 37. The well is selected from drop down menus at the top of the view that allow for user selection of a particular oil field and a particular well within that oil field. Note that the view of FIG. 5B also includes a horizontal gauge displayed in the top left portion of the view that provides a visual indication of the PFI value for the given well and which is described above with respect to FIG. 5A.

Note that the graphical user interfaces generated by the presentation logic of the management system 37 may include other views, such as a view that displays the operating voltage, amperage, and possibly other operating parameters of the ESP system for one or more wells in order to aid the user in analysis of current imbalances and system efficiencies. It is contemplated that such view(s) may include a horizontal gauge that provides a visual indication of the PFI value for the ESP system, and which is described above with respect to FIG. 5A.

Advantageously, the present invention provides improved mechanisms for predicting the failure of ESP systems and reporting such predictions to users. Importantly, the predictions are based on the acquisition, collection and storage of sufficient data on key operating points of the ESP system. Such mechanisms also provide a simple and intuitive interface that allows users to modify and update the fault prediction mechanism during the operational lifetime of the ESP system in order to ensure accurate fault prediction over time. Because the simple and intuitive interface does not require extensive training or experience to understand, a wide range of operators of varying skill levels can monitor and analyze the operating conditions of the ESP system, which aids in reducing monitoring costs over the operational lifetime of the ESP system.

There have been described and illustrated herein several embodiments of a system and method for real-time monitoring and failure prediction of electrical submersible pumps. While particular embodiments of the invention have been described, it is not intended that the invention be limited thereto. Thus, while particular ESP operating parameters and ESP sensor locations have been disclosed, it will be appreciated that other ESP operating parameters and ESP sensor locations can be used as well. In addition, while particular methods and calculations are disclosed for generating data that characterizes the current operating parameters of an ESP system as well as for characterizing the departure of the current operating parameters relative to user-supplied stable values and combining such characterizations to generate a failure predictive index or score, variations on such algorithms and calculations can be used without departing from the scope of the invention. For example, and not by way of limitation, the algorithm might average the operating measurements captured over one or more time intervals in order to characterize the current operating parameters of the ESP. Also, while it is preferred that the data collection, analysis, monitoring, failure prediction, and alerts be performed by a system disposed at a location remote from the wellsite (e.g., a centralized management system), it will be recognized that such functionality can be performed by a system that is located at or near the wellsite. Moreover, while particular configurations have been disclosed in reference to the electrical submersible pump system of the well, it will be appreciated that other configurations could be used as well. For example, the electrical submersible pump system may comprise a single or multiple pumps coupled directly together or disposed at separate locations along the wellbore. In many applications, the electrical submersible pump system comprises one to five pumps. It will therefore be appreciated by those skilled in the art that yet other modifications could be made to the provided invention without deviating from its scope as claimed.

What is claimed is:

1. A method of monitoring an electrical submersible pump disposed downhole in a subterranean wellbore including:

storing a plurality of first measurement values in a management system that comprises at least one computer, each first measurement value associated with one of a plurality of operating parameters of the electrical submersible pump, said plurality of first measurement values obtained during downhole operation of the electrical submersible pump over time;

the management system being at least partially connected with the electrical submersible pump remotely by way of a data communications network;

obtaining a plurality of user-supplied stable operating values corresponding to said plurality of operating parameters and inputting the user-supplier stable operation parameters to the management system;

generating a failure prediction value with the management system by calculating a percentage change of the respective first measurement values and the corresponding user-supplied stable operating values, the failure prediction value representing likelihood of failure of the electrical submersible pump; and storing said failure prediction value in the management system for subsequent output and monitoring of the electrical submersible pump.

2. A method according to claim 1, wherein:

said plurality of first measurement values are associated with a plurality of operating parameters of the electrical submersible pump selected from the group including: operating amperage, current leakage, current imbalance, motor temperature, pump performance index, discharge pressure, intake pressure, discharge vibration, intake vibration, and motor vibration.

3. A method according to claim 1, further comprising:

for each given operating parameter of said plurality of operating parameters, generating a corresponding second measurement value based upon at least one first measurement value, and generating a corresponding third measurement value based upon a difference between said corresponding second measurement value and a corresponding user-supplied stable operating value;

wherein said failure prediction value is based upon said third measurement values corresponding to said plurality of operating parameters.

4. A method according to claim 3, wherein:

the second measurement value for a respective operating parameter is generated by retrieving a first measurement value associated with the respective operating parameter that was measured during a most recent polling interval.

5. A method according to claim 3, wherein:

the third measurement value for a respective operating parameter is calculated as a percentage change of said corresponding second measurement value from said corresponding user-supplied stable operating value.

6. A method according to claim 3, wherein:

said failure prediction value is calculated by mapping said third measurement values to weight factor values, scaling said weight factor values by a set of corresponding confidence ratings to generate a set of resultant products, and then adding the resultant products.

7. A method according to claim 6, wherein:

the mapping of said third measurement values to weight factor values is fixed and unalterable by a user.

8. A method according to claim 6, wherein:

said confidence ratings are fixed and unalterable by a user.

9. A method according to claim 1, further comprising:

generating at least one graphical user interface based upon said failure prediction value; and outputting said at least one graphical user interface for display to a user.

10. A method according to claim 9, wherein: said at least one graphical user interface includes at least one of: i) a display of said failure prediction value itself; ii) at least one visual alarm that is raised in the event that the failure prediction value exceeds a predetermined threshold value; iii) a description of the underlying cause of an alarm condition that is raised in the event that the failure prediction value exceeds a predetermined threshold value; and iv) a gauge that visually depicts said failure prediction value.

11. A method according to claim 9, wherein:

said at least one graphical user interface includes other well surveillance information.

12. A method according to claim 9, wherein:

said at least one graphical user interface is realized as a web page.

13. A method according to claim 9, further comprising:

communicating said at least one graphical user interface over a data communication network for display at a client computing device.

14. A method according to claim 1, further comprising:

communicating said plurality of first measurement values over a data communication network for storage at a location remote from the wellbore.

15. A method according to claim 1, further comprising:

dynamically updating at least one user-supplied stable operating value based upon user input.

16. A method according to claim 15, further comprising:

outputting a graphical user interface to the user, said graphical user interface providing for dynamic update of at least one user-supplied stable operating value; and updating the at least one user-supplied stable operating value in accordance with user interaction with said graphical user interface.

17. A system for monitoring an electrical submersible pump disposed downhole in a subterranean wellbore including: data logging means for storing a plurality of first measurement values, each first measurement value associated with one of a plurality of operating parameters of the electrical submersible pump, said plurality of first measurement values obtained during downhole operation of the electrical submersible pump over time; failure prediction means including i) means for obtaining a plurality of user-supplied stable operating values corresponding to said plurality of operating parameters;

ii) means for generating a failure prediction value by calculating a percentage change of respective first measurement values and the corresponding user-supplied stable operating values, the failure prediction value representing likelihood of failure of the electrical submersible pump; and iii) data storage for storing said failure prediction value for subsequent output and monitoring of the electrical submersible pump.

18. A system according to claim 17, wherein:

said plurality of first measurement values are associated with a plurality of operating parameters of the electrical submersible pump selected from the group including:

operating amperage, current leakage, current imbalance, motor temperature, pump performance index, discharge pressure, intake pressure, discharge vibration, intake vibration, and motor vibration.

19. A system according to claim 17, wherein:

said means for generating a failure prediction value includes means operating, for each given operating parameter of said plurality of operating parameters, to generate a corresponding second measurement value based upon at least one first measurement value, and to generate a corresponding third measurement value based upon a difference between said corresponding second measurement value and a corresponding user-supplied stable operating value; and wherein said failure prediction value is based upon said third measurement values corresponding to said plurality of operating parameters.

20. A system according to claim 19, wherein:

the second measurement value for a respective operating parameter is generated by retrieving a first measurement value associated with the respective operating parameter that was measured during a most recent polling interval.

21. A system according to claim 19, wherein:

the third measurement value for a respective operating parameter is calculated as a percentage change of said corresponding second measurement value from said corresponding user-supplied stable operating value.

22. A system according to claim 19, wherein:

said failure prediction value is calculated by mapping said set of third measurement values to weight factor values, scaling said weight factor values by a set of corresponding confidence ratings to generate a set of resultant products, and then adding the resultant products.

23. A system according to claim 22, wherein:

the mapping of said third measurement values to weight factor values is fixed and unalterable by a user.

24. A system according to claim 22, wherein:

said confidence ratings are fixed and unalterable by a user.

25. A system according to claim 17, further comprising:

means for generating at least one graphical user interface based upon said failure prediction value; and means for outputting said at least one graphical user interface for display to a user.

26. A system according to claim 25, wherein:

said at least one graphical user interface includes at least one of:

i) a display of said failure prediction value itself;

ii) at least one visual alarm that is raised in the event that the failure prediction value exceeds a predetermined threshold value;

iii) a description of the underlying cause of an alarm condition that is raised in the event that the failure prediction value exceeds a predetermined threshold value; and iv) a gauge that visually depicts said failure prediction value.

27. A system according to claim 25, wherein:

said at least one graphical user interface includes other well surveillance information.

28. A system according to claim 25, wherein:

said at least one graphical user interface is realized as a web page.

29. A system according to claim 25, further comprising:

communicating said at least one graphical user interface over a data communication network for display at a client computing device.

30. A system according to claim 17, further comprising:

a data acquisition system, operably coupled to a plurality of sensors deployed within said wellbore, said data acquisition system collecting said plurality of first measurement values; and data communication means for communicating said plurality of first measurement values from said data acquisition system to a management system disposed at a location remote from the wellbore for storage therein.

31. A system according to claim 17, further comprising:

means for dynamically updating at least one user-supplied stable operating value based upon user input.

32. A system according to claim 31, further comprising:

means for generating and outputting a graphical user interface to the user, said graphical user interface providing for dynamic update of at least one user-supplied stable operating value; and means for updating the at least one user-supplied stable operating value in accordance with user interaction with said graphical user interface.

* * * * *